US009675124B2

(12) United States Patent
Vito et al.

(10) Patent No.: US 9,675,124 B2
(45) Date of Patent: Jun. 13, 2017

(54) JOINT PROTECTOR SYSTEM

(71) Applicant: Matscitechno Licensing Company, Kennett Square, PA (US)

(72) Inventors: Robert A. Vito, Kennett Square, PA (US); Michael Foerster, Newtown Square, PA (US)

(73) Assignee: Matscitechno Licensing Company, Kennett Square, PA (US)

( * ) Notice: Subject to any disclaimer, the term of this patent is extended or adjusted under 35 U.S.C. 154(b) by 0 days.

(21) Appl. No.: 14/645,641

(22) Filed: Mar. 12, 2015

(65) Prior Publication Data

US 2016/0262465 A1 Sep. 15, 2016

(51) Int. Cl.
*A41D 13/015* (2006.01)
*A41D 13/08* (2006.01)
*A41D 13/05* (2006.01)

(52) U.S. Cl.
CPC ..... *A41D 13/08* (2013.01); *A41D 13/088* (2013.01); *A41D 2400/38* (2013.01); *A41D 2600/10* (2013.01)

(58) Field of Classification Search
CPC ..... A63B 71/141; A63B 60/54; A63B 71/143; A63B 71/08; A63B 71/12; A63B 71/148; A63B 2244/10; A63B 69/004; A63B 71/0054; A63B 71/14; A63B 71/145; F16F 1/3605; F16F 1/40; A41D 13/0153; A41D 13/0587; A41D 13/0593; A41D 13/08; A41D 13/081; A41D 31/0044; A41D 13/0015; A41D 13/05; A41D 13/0543; A41D 13/06; A41D 13/065; A41D 13/088; A41D 31/0061; A41D 13/015
See application file for complete search history.

(56) References Cited

U.S. PATENT DOCUMENTS

| | | | | |
|---|---|---|---|---|
| 4,183,098 | A * | 1/1980 | Knowles, Jr. | A63B 69/0046 2/16 |
| 5,388,271 | A * | 2/1995 | Sessoms | A41D 13/0015 2/113 |
| 6,519,781 | B1 * | 2/2003 | Berns | A41D 13/0153 2/267 |
| 6,944,974 | B2 * | 9/2005 | Falone | A41D 13/015 36/30 R |
| 2003/0046747 | A1 * | 3/2003 | Berns | A41D 13/0153 2/69 |
| 2005/0197611 | A1 * | 9/2005 | Taranow | A61F 5/01 602/62 |

(Continued)

*Primary Examiner* — Bobby Muromoto, Jr.
(74) *Attorney, Agent, or Firm* — RatnerPrestia

(57) ABSTRACT

Joint protectors are disclosed. One such joint protector includes a first pad having a first axis; a second pad having a second axis; a connector coupled to the first and second pads, wherein the connector is configured to attach the first and second pads to a user's limb such that the first pad is positioned on one side of the user's joint and the second pad is positioned on an opposite side of the user's joint. Furthermore, the joint protector is movable to be in a first state, wherein the first axis aligns with the second axis and the end of the first pad aligns with the end of the second pad, and to be in a second state, wherein the first axis is angled relative to the second axis and the end of the first pad is not aligned with the end of the second pad.

10 Claims, 8 Drawing Sheets

(56) References Cited

U.S. PATENT DOCUMENTS

| | | | | |
|---|---|---|---|---|
| 2005/0268365 | A1* | 12/2005 | Sandebeck | A63B 71/08 2/16 |
| 2005/0273030 | A1* | 12/2005 | Koby | A61F 5/0118 602/60 |
| 2006/0168710 | A1* | 8/2006 | Vito | A42B 3/12 2/267 |
| 2007/0204373 | A1* | 9/2007 | Loyens | A41D 13/08 2/16 |
| 2007/0293797 | A1* | 12/2007 | Koby | A41D 13/088 602/21 |
| 2008/0086789 | A1* | 4/2008 | Dick | A41D 13/06 2/2.5 |
| 2011/0167529 | A1* | 7/2011 | Anderson | A41D 13/0543 2/2.5 |
| 2011/0302700 | A1* | 12/2011 | Vito | A42B 3/14 2/412 |
| 2012/0304356 | A1* | 12/2012 | Brewer | A61F 5/013 2/16 |
| 2013/0025036 | A1* | 1/2013 | Turner | A42B 3/125 2/455 |
| 2013/0227755 | A1* | 9/2013 | Bisaillon | A41D 13/081 2/20 |
| 2014/0068842 | A1* | 3/2014 | Vito | A42B 3/127 2/414 |
| 2014/0206248 | A1* | 7/2014 | Vito | B32B 5/022 442/2 |

* cited by examiner

JOINT PROTECTOR SYSTEM

FIELD OF THE INVENTION

The invention relates generally to the field of protective gear, and more particularly, to protective joint gear.

BACKGROUND OF THE INVENTION

Conventionally, participants in sports (e.g. football, rugby, baseball, lacrosse, field hockey, etc.) wear protective gear to cushion the force of impacts that are regularly received during those events. In recent years, the dangers of high-force impacts to the elbow, knee, wrist, or other joints during such contact sports have been a matter of focus. The dangers of these impacts can be diminished or minimized by effectively cushioning participants from the forces of impacts. Accordingly, improved structures, such as impact-resistant joint gear, are desired to better protect and lessen the impact forces experienced by those participants.

SUMMARY OF THE INVENTION

Aspects of the invention are directed to joint protectors. In accordance with one aspect of the present invention, a joint protector has a first pad having a length extending along a first axis; a second pad separate from the first pad and having a length extending along a second axis, an end of the first pad adjacent the second pad and configured to align with an end of the second pad that is adjacent the first pad. The joint protector further has a connector coupled to the first and second pads, the connector configured to attach the first and second pads to a limb of a user such that the first pad is positioned on one side of the joint of the user and the second pad is positioned on an opposite side of the joint of the user, wherein the joint protector is movable to be in a first state in which the first axis aligns with the second axis and the end of the first pad aligns with the end of the second pad, and to be in a second state in which the first axis is angled relative to the second axis and the end of the first pad is not aligned with the end of the second pad.

In accordance with another aspect of the present invention, the joint protector has a pad having a length and a pair of opposed ends along the length, the pad having a concave shape. The joint protector further has a connector coupled to the pad, the connector configured to attach the pad to a limb of a user such that one end of the pad is positioned on one side of the user's wrist and the opposite end of the pad is positioned on an opposite side of the user's wrist.

BRIEF DESCRIPTION OF THE DRAWINGS

The invention is best understood from the following detailed description when read in connection with the accompanying drawings, with like elements having the same reference numerals. When a plurality of similar elements are present, a single reference numeral may be assigned to the plurality of similar elements with a small letter designation referring to specific elements. When referring to the elements collectively or to a non-specific one or more of the elements, the small letter designation may be dropped. According to common practice, the various features of the drawings are not drawn to scale unless otherwise indicated. To the contrary, the dimensions of the various features may be expanded or reduced for clarity. Included in the drawings are the following figures.

DETAILED DESCRIPTION OF THE INVENTION

The exemplary apparatuses disclosed herein are configured to lessen the force of an impact on the user's protected joint, while still providing sufficient protection and comfort. This makes the disclosed apparatuses particularly suitable for use by participants in athletic activities, and particularly suitable for participants in contact sports, including, but not limited to football, rugby, baseball, karate, lacrosse, and field hockey, where high-force impacts may be commonly experienced.

While the exemplary embodiments of the invention are described herein with respect to athletic activities, it will be understood that the invention is not so limited. Suitable applications for apparatuses of the present invention include, for example, military gear, police gear, and construction gear. Other suitable applications will be readily understood by one of ordinary skill in the art from the description herein. Additionally, as used herein, the term "impact-resistant" is intended to encompass any object that partially or fully lessens, diminishes, dissipates, deflects, or absorbs the mechanical force of an impact.

Figure 1:
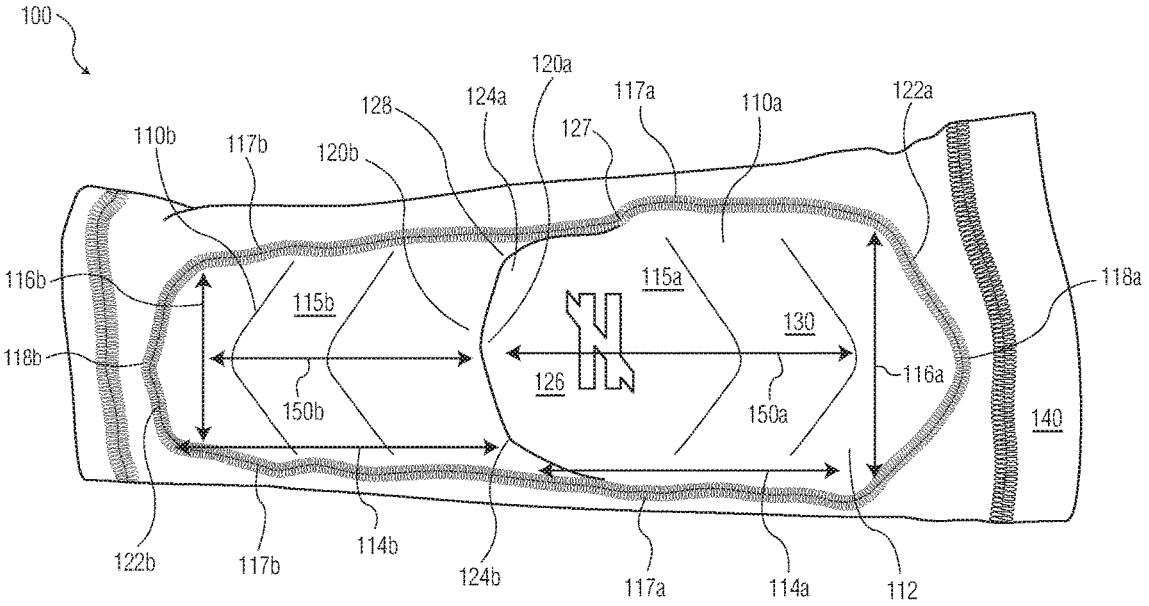
FIG. 1 is a diagram illustrating a top-view of an exemplary joint protector in accordance with aspects of the present invention.

Referring now to the drawings, FIG. 1 illustrates an exemplary joint protector 100 in accordance with aspects of the present invention. Joint protector 100 may be worn on a user's elbow during an athletic activity. As a general overview, joint protector 100 includes one or more pads 110 and a connector 140.

Pads 110 are formed from impact-resistant materials. Where multiple pads 110 are used, the pads form a padding layer 112 along the user's limb. Pads 110 in padding layer 112 may include the same or different types of impact-resistant materials. In an exemplary embodiment, the padding layer 112 includes a layer of an elastomeric material and a layer of high-tensile strength fibrous material. The elastomeric material may provide impact-resistance by absorbing and/or dissipating the forces of impacts along the surface of the elastomeric material. The high tensile strength fibrous materials may be integrated into other materials in the padding layer 112 and/or form one or more separate layers. In one embodiment, a layer of high-tensile strength fibrous material is located between two or more layers of elastomeric material. In another embodiment, the outer layer of the padding layer 112 is an impact-resistant material that dissipates impacts along the surface while inner impact-resistant materials absorb the impact. For example, the padding layer 112 may include an inner layer of elastomeric material and an outer adjacent layer of high-tensile strength fibrous material. A protective coating, e.g. a durable plastic, may be placed on the outer adjacent layer of high-tensile strength fibrous material to protect such layer from rips, tears, or punctures. In yet a further embodiment, the outer layer is of an elastomeric material as it may be less susceptible to such damage than the layer of high-tensile strength fibrous material.

Suitable materials for forming the elastomeric layer(s) include, but are not limited to, urethane rubbers, silicone rubbers, nitrile rubbers, butyl rubbers, acrylic rubbers, natural rubbers, styrene-butadiene rubbers, and the like. In general, any suitable elastomer material can be used to form the above-described elastomeric layers without departing from the scope of the present invention. Suitable materials for forming the layer of high-tensile strength fibrous material include, but are not limited to, aramid fibers, fiberglass, or other high-tensile strength fibers. The high-tensile strength fibers may be woven to form a cloth layer that is disposed between and generally separates the opposing elastomeric layers. The high-tensile strength fibrous material layer may block and redirect impact energy that passes through one of the elastomeric layers.

Desirably, the materials utilized in the padding layer 112 will enable pads 110 to preserve their shape after receiving an impact or being deformed. In particular, pads 110 are formed of a material that retains its shape when the user bends his or her joint. Additional description of materials for forming padding layer 112 may be found in U.S. patent application Ser. No. 09/978,130, the contents of which are incorporated herein by reference in their entirety for all purposes.

The size and shape of the joint protector 100, and particularly the size and shape of the one or more pads 110, affect the level of protection and comfort of the user. Accordingly, each pad 110 has a shape and size selected based on the desired level of protection and comfort for a particular user. As shown in FIG. 1, each pad 110 has a length 114 extending along an axis 150 thereof, as well as a width 116. The axis 150 of each pad 110 extends substantially parallel with the user's limb when joint protector 100 is worn. The length 114 and width 116 of the pads 110 may vary depending on the size of the user's joint and limbs. Generally, the length 114 and/or the width 116 of the pads 110 is larger for adults than for children and generally larger for males than for females. Although FIG. 1 depicts two pads 110*a* and 110*b*, a person of ordinary skill in the art would understand that more or fewer than two pads may be utilized as desired. In one embodiment, the length 114*a* and/or width 116*a* of first pad 110*a* may differ from the length 114*b* and/or width 116*b* of the second pad 110*b*, to facilitate improved protection of the user's joint and/or limbs.

Additionally, the length 114 and width 116 of pads 110 may vary depending on which joint the joint protector 100 is configured to protect. Joint protector 100 is configured such that, when it is worn, the first pad 110*a* is positioned on one side of the joint of the user and the second pad 110*b* is positioned on the opposite side of the joint of the user. Joint protectors 100 configured for a user's knee may utilize one or more pads 110 with a size and shape that is larger than joint protectors 100 configured for a user's elbow or wrist.

In an exemplary embodiment, a joint protector 100 configured to be worn on a user's knee may have a first pad 110*a* with a length 114*a* of between about three inches and about nine inches and a width 116*a* of between about two inches and about nine inches. In this exemplary embodiment, joint protector 100 may have a second pad 110*b* with a length 114*b* of between about three inches and about sixteen inches and a width 116*b* of between about two inches and about nine inches.

In an alternative embodiment, a joint protector 100 configured to be worn on a user's elbow may have a first pad 110*a* with length 114*a* of between about three inches and about nine inches and a width 116*a* of between about one inch and about six inches. In this embodiment, joint protector 100 has a second pad 110*b* with a length 114*b* of between about two inches and about eight inches and a width 116*b* of between about one inch and about six inches.

The one or more pads 110 has a first end 118 and an opposing second end 120 along an axis 150. Although, for purposes of facilitating the description of aspects of invention herein, the first end 118 of the pad 110 is the end further from the user's joint, it is understood that nomenclature is not limiting. The second end 120 of the pad 110 may cover and/or be near the user's joint. The first end 118 of the pad 110 may have a contour 122. The second end 120 of the pad 110 may also have a contour 124. The contour 122 of the first end 118 may be dissimilar to the contour 124 of the second end 120. Additionally, where more than one pad 110 is utilized, the contours 122*a* and/or 124*a* of a first pad 110*a* may be dissimilar to the contours 122*b* and/or 124*b* of the second pad 110*b*.

Figure 2:
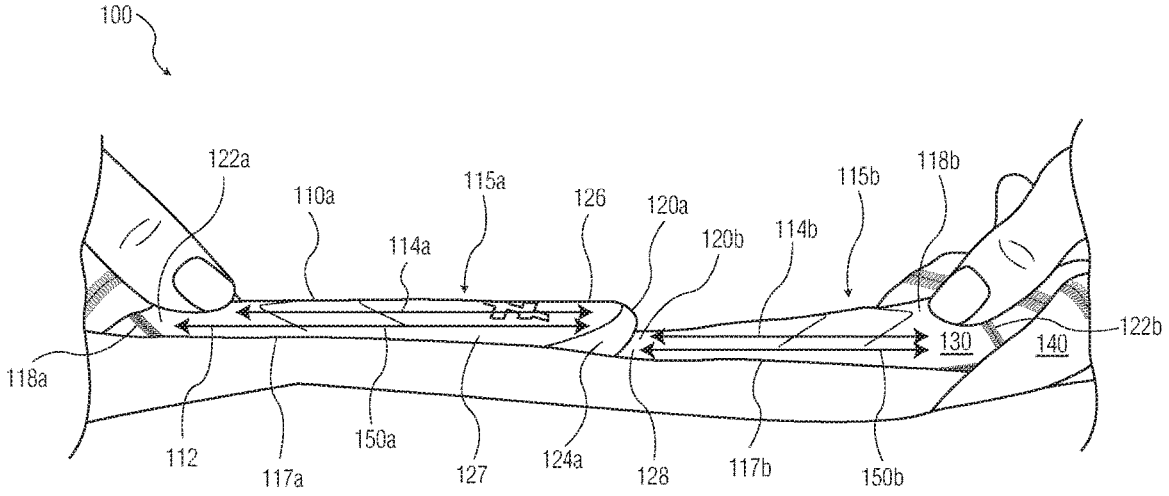
FIG. 2 is a diagram illustrating a side-view of an exemplary joint protector in a first state according to aspects of the present invention.
Figure 3:
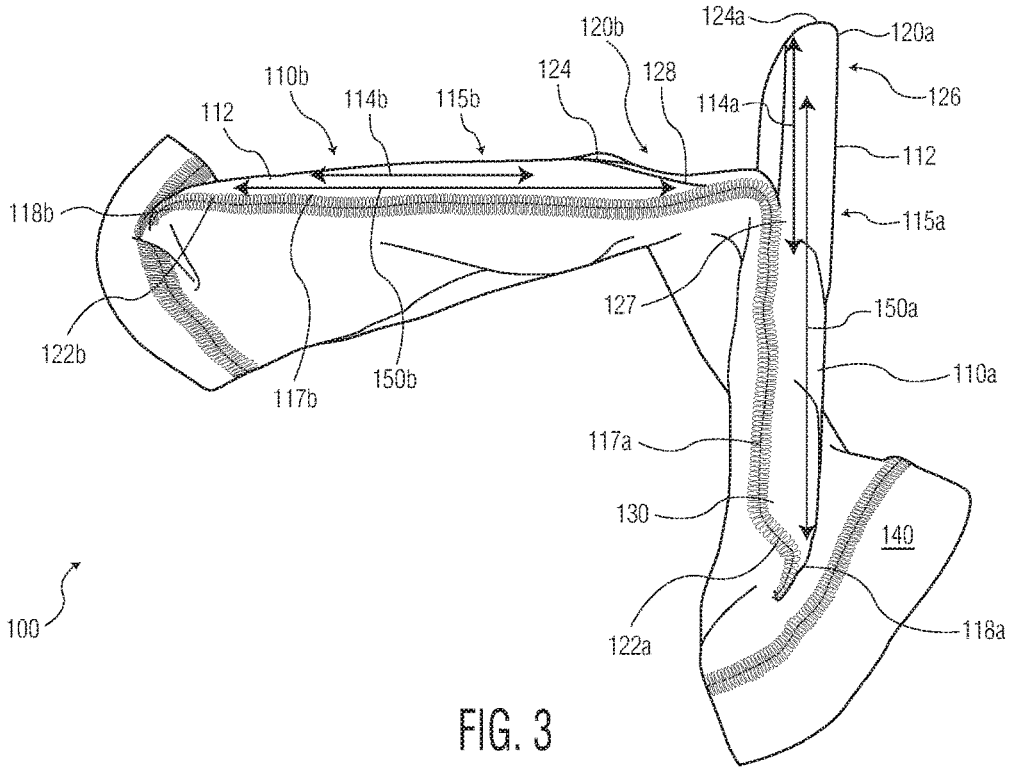
FIG. 3 is a diagram illustrating a side-view of an exemplary joint protector in a second state according to aspects of the present invention.

FIGS. 1, 2, and 3 depict one embodiment of joint protector 100. Referring to FIG. 1, joint protector 100 employs a first pad 110*a* and a second pad 110*b*, which are positioned so that the length 114*a* and width 116*a* of the first pad 110*a* and the length 114*b* and width 116*b* of the second pad 110*b* extend in the same directions. The padding layer 112 of the first pad 110*a* and the second pad 110*b* may provide a continuous area of protection. FIG. 3 depicts joint protector 100, where the second pad 110*b* is perpendicular relative to the first pad 110*a*. As seen in FIG. 3, the pads 110 are oriented so that the length 114*a* of the first pad 110*a* and the length 114*b* of the second pad 110*b* do not extend in the same direction. Preferably, the width 116*a* of the first pad 110*a* and the width 116*b* of the second pad 110*b* are extending in the same direction regardless of the positioning of the first pad 110*a* with respect to the second pad 110*b*, when joint protector 100 is worn by the user.

Joint protector 100 may also include a fabric layer 130 in accordance with aspects of the present invention. Fabric layer 130 may be configured to partially (e.g., adjacent a portion of one or more surfaces of the pad) or fully surround the one or more pads 110. Additionally, fabric layer 130 may be affixed to the connector 140. Affixing fabric layer 130 to the connector 140 may be one way to couple pads 110 to connector 140. The fabric layer 130 may be affixed to pads 110 or connector 140 by way of adhesives, hot pressing, and/or mechanical features, such as stitching, snaps, buttons, zippers, Velcro, and the like. Fabric layer 130 may also provide additional protection for the padding layer 112 of the pads 110.

Connector 140 is coupled to the one or more pads 110. The connector 140 may be made of an elastic material or a non-elastic material. The connector 140 may be configured as straps, a sleeve, and/or the like, so long as the connector 140 can attach the pads 110 to the joint and/or limb of the user. In one embodiment, as shown in FIGS. 1-3, connector 140 is configured as a sleeve that has a length that is longer than the sum of the length 114*a* of the first pad 110*a* and the length 114*b* of the second pad 110*b*. In an alternative embodiment, the connector 140 may not be coupled to the pad 110 along the entire length of the pad 110. In this embodiment, connector 140 is coupled to the base 127 of the projecting portion 126 of the pad 110 along the respective side edges 117 along the width 116 of pad 110, as discussed below.

The pads 110 may be coupled directly to the connector 140, or may be coupled indirectly by way of fabric layer 130. Desirably, the manner or method of coupling the pads 110 to connector 140 enables the user to receive high-force impacts without the pads 110 being displaced relative to the user's limb or joint. Additionally, the one or more pads 110 may be removable from the joint protector 100. To enable the removal of the pads 110, fabric layer 130 may partially surround the one or more pads 110. Alternatively or additionally, fabric layer 130 may be affixed to connector 140 in a manner that enables the user to remove pads 110. By way of example, fabric layer 130 may be affixed to connector 140 on fewer than all sides of pads 110—e.g., along the width 116 and along one end 118 or 120 of pads 110—to facilitate removal of pads 110 through the non-affixed area. By way of further example, fabric layer 130 and/or pads 110 may be affixed to connector 140 by way of removable and/or separable mechanisms, such as buttons, Velcro, zippers, or the like, to enable the user to separate the fabric layer 130 from the connector 140 to remove the pad 110.

In one embodiment, pad 110 has a projecting portion 126. As seen in FIG. 3, the projecting portion 126 of the first pad 110*a* extends from the projecting portion base 127, which may be attached to connector 140. Preferably, the projecting portion 126 extends beyond the user's joint or limb, while the user wears joint protector 100 in the second state. The projecting portion 126 may contain the same or different types of materials as pad 110*a*, provided that the rigidity enables the projecting portion 126 to extend from joint protector 100. A projecting portion 126 of a pad 110 may be formed by a portion of pad 110 that is not secured to connector 140. Joint protector 100 may be configured so that projecting portion 126 of the pad 110 is positioned to cover the user's joint when joint protector 100 is worn by the user.

Additionally, where more than one pad 110*a* and 110*b* is employed, the joint protector 100 is configured so that the first pad 110*a* and second pad 110*b* are moveable with respect to each other. Preferably, the user can move the first pad 110*a* with respect to the second pad 110*b* with minimal hindrance. For example, in a preferred embodiment, the user is not required to bend, deform, or move the pads 110 to move his or her limb. The joint protector 100 may be configured to have a first state and a second state based on the position of the joint protector 100 and/or the position of the first pad 110*a* with respect to the second pad 110*b*.

FIG. 2 is an exemplary illustration of one implementation of the joint protector 100 in the first state. In the first state, padding layer 112 may provide a continuous area of protection extending from a portion of the limb on one side of the joint to a portion of the limb on the other side of the joint. In one embodiment, the position of the first pad 110*a* and the position of the second pad 110*b* is such that the first axis 150*a* and the second axis 150*b* are substantially parallel. As used herein, substantially parallel means that the angle between the first axis 150*a* and the second axis 150*b* is less than 20°. In this embodiment, the top surface 115*a* of the first pad 110 and the top surface 115*b* of the second pad 110*a* form a continuous contour along the length 114*a* of the first pad 110*a* and along the length 114*b* of the second pad 110*b* when joint protector 100 is in the first state. The respective side edges 117*a* of the first pad 110*a* and the respective side edges 117*b* of the second pad 110*b* may also be aligned.

The ends 118 and 120 of pads 110 may have a contour 122 and/or 124 respectively. The end 120*a* of the first pad 110*a* may have a first contour 124*a*, and the end 120*b* of the second pad 110*b* may have second contour 124*b* shaped to mate with the first contour 124*a*. The shape of the contour 120 may include curves, angles, and/or straight portions. Mating may occur by way of a projecting portion 126 on one pad 110*a* or 110*b* mating with the indent portion 128 having a size and shape corresponding to the projecting portion 126 on the other pad 110*a* or 110*b*. The projecting portion 126 may overlap a separate pad 110 or a portion of a separate pad 110 in the first state. For example, a projecting portion 126*a* of a first pad 110*a* may overlap a portion of the second pad 110*b*. In this embodiment, the end 120*a* of the first pad 110*a* and the end 120*b* of the second pad 110*b* are not aligned. Additionally, in this embodiment, axis 150*a* of pad 110*a* and the axis 150*b* of pad 110*b* are not parallel. By overlapping the projecting portion 126 of the first pad 110*a* over a portion of a separate pad 110, the thickness of the padding layer 112 may be increased in the overlapped portion to provide additional protection to a user's joint or limb.

FIG. 3 is an exemplary illustration of one implementation of the joint protector 100 in the second state. Although the axis 150*a* of the first pad 110*a* is depicted in FIG. 3 as perpendicular to the axis 150*b* of the second pad 110*b*, it should be understood that the second state includes any positioning of the joint protector 100 and/or positioning of the first pad 110*a* with respect to the second pad 110*b* that is outside of the first state. Connector 140 may be coupled to pads 110 as to maintain one or more pads 110 against the user's limb along the entire length of the pads 110. In one embodiment, connector 140 maintains the second pad 110*b* against the limb of the user along its entire length 114*b*. In another embodiment, a portion of the first pad 110*a* (e.g., the projecting portion 126 of the first pad 110*a*) is not maintained against the limb of the user by the connector 140 (e.g., elastic material) along its entire length 114*a*. In this embodiment, the portion of pad 110*a* that is not maintain against the limb of the user separates from the connector 140. Typically, this occurs in the second state when the user moves the limb attached at his or her joint. As the user moves the limb attached to his or her joint, the portion of pad 110*a* that is not maintained against the user separates from connector 140 because of the rigidity of the pad 110*a* and/or projecting portion 126.

The joint protector 100 may not have a pad 110 located underneath the projecting portion 126. Thus, it is desirable to configure the projecting portion 126 so that the likely impact, considering the respective sport or activity, does not impact the user underneath the projecting portion 126. By way of example, for joint protectors configured to protect a user's elbow in baseball, the projecting portion 126 may be at the second end 120*a* of the first pad 110*a* so that when the user bends his or her arm to swing the bat, the elbow is always protected from an incoming baseball pitch. This configuration is beneficial for protecting elbows as impacts to the portion of the elbow connected to the lower arm are safer than impacts to the portion of the elbow connected to the upper arm where numerous tendons and/or ligaments are vulnerable. In one implementation of this configuration, the user does not have to bend or deform the one or more pads 110 to bend his or her arm or swing a bat. By way of further example, for joint protectors configured to protect a user's knee in soccer or karate, the projecting portion 126 may be located at the second end 120*b* of the second pad 110*b* so that while bending his or her knee, the user's lower portion of the knee, e.g. the knee cap, head of the femur, the associated cartilage, ligaments, tendons, etc., is protected. Additionally or alternatively, the joint protector 100 may have a third pad or a portion of a second pad 110*b* underneath the projecting portion 126.

Figure 4:
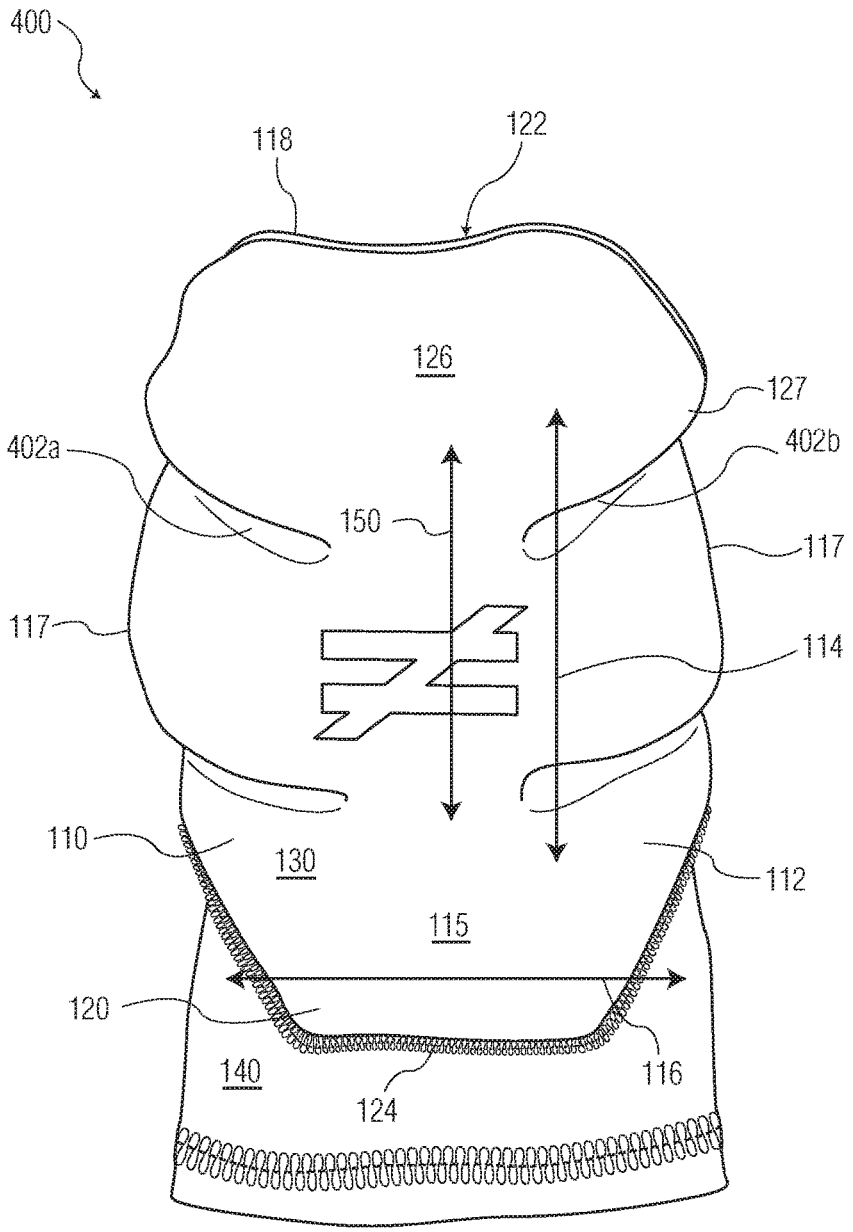
FIG. 4 is a diagram illustrating a top-view of one implementation of a joint protector configured for a user's wrist according to aspects of the present invention.
Figure 5:
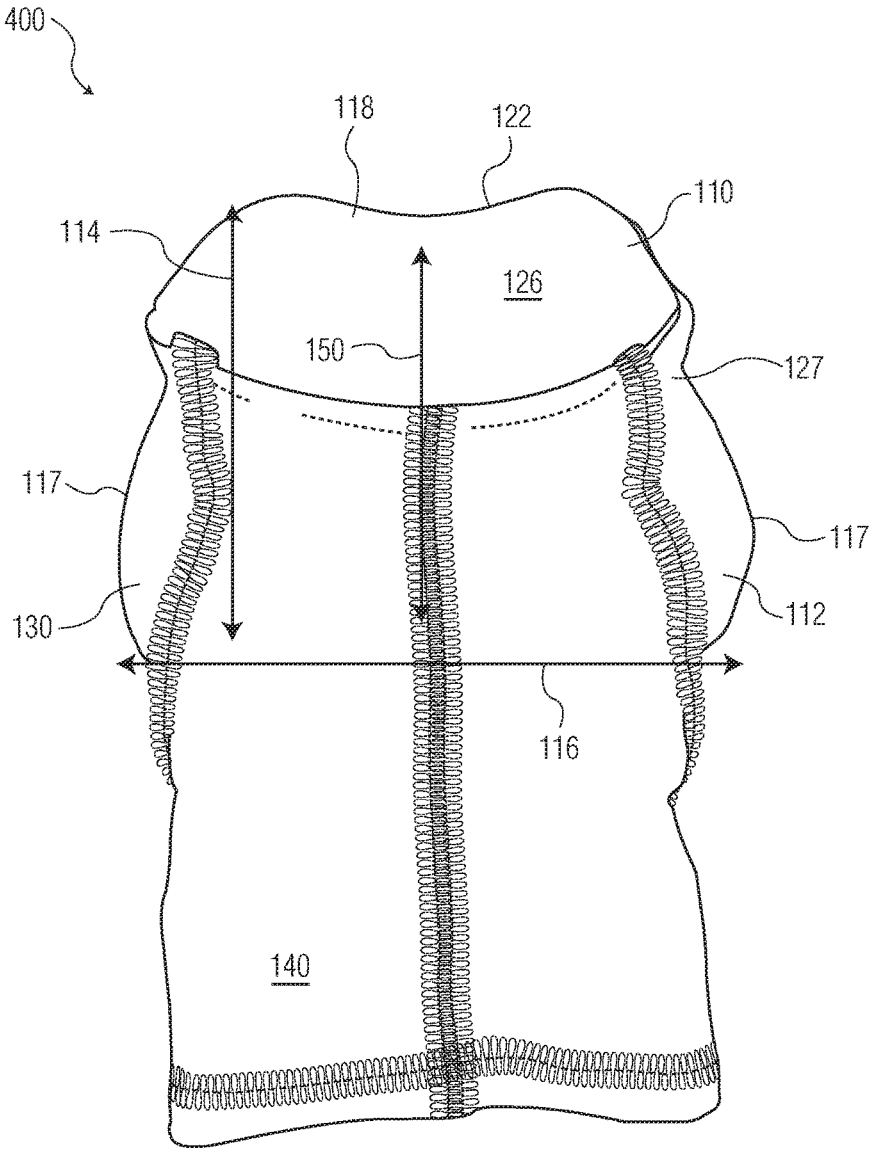
FIG. 5 is a diagram illustrating a bottom-view of one implementation of a joint protector configured for a user's wrist according to aspects of the present invention.
Figure 6:
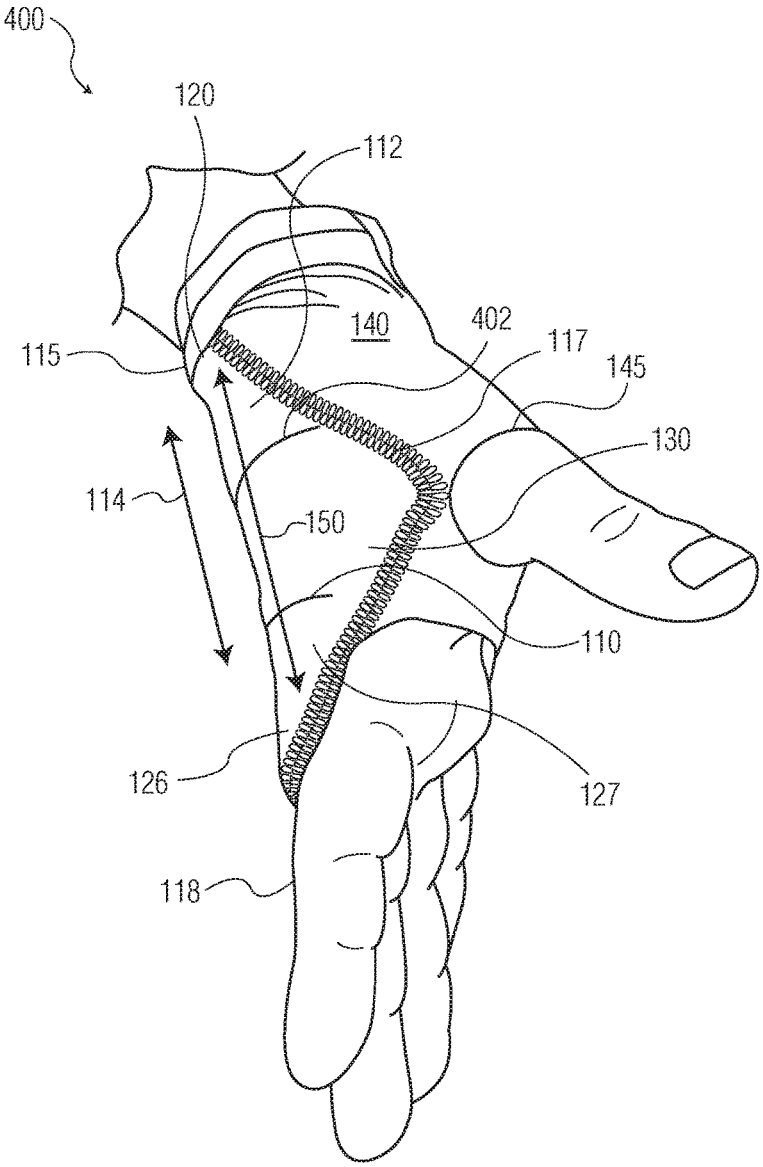
FIG. 6 is a diagram illustrating a side-view of one implementation of a joint protector configured for a user's wrist and having a thumb-hole according to aspects of the present invention.
Figure 7:
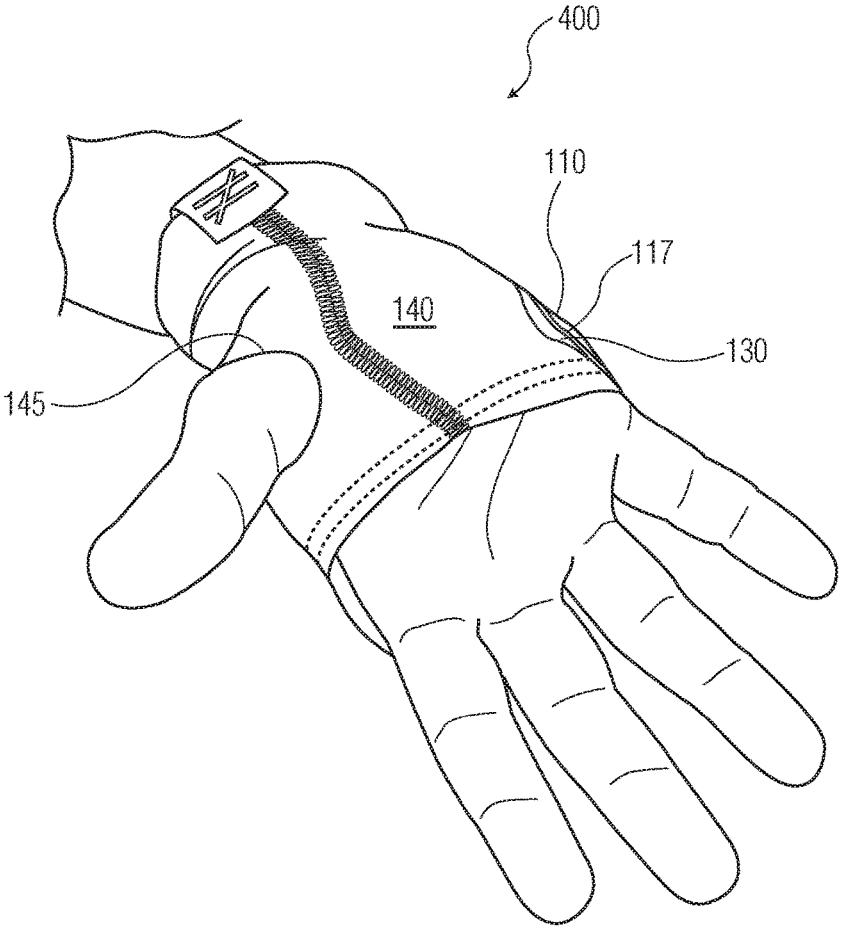
FIG. 7 is a diagram illustrating a bottom-view of the joint protector of FIG. 6.
Figure 8:
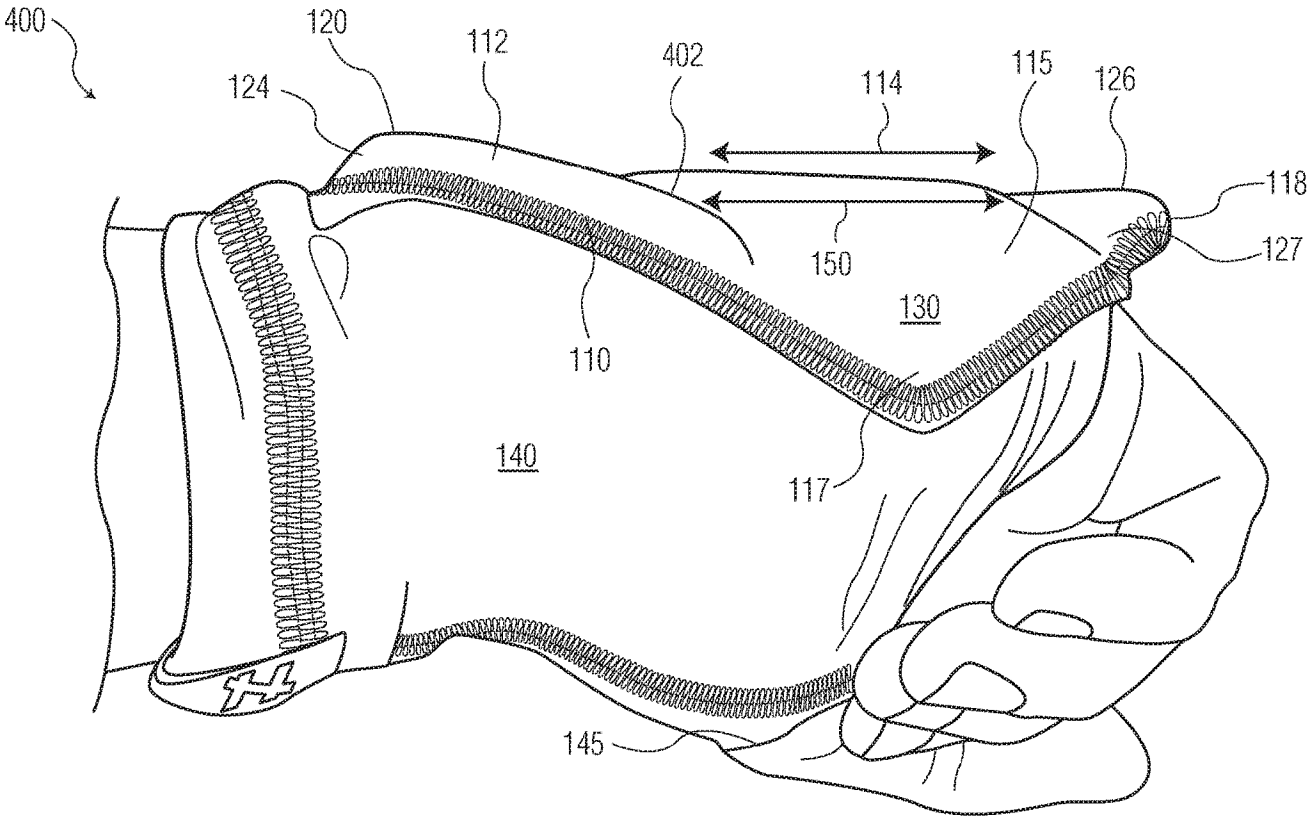
FIG. 8 is a diagram illustrating a side-view of the joint protector of FIG. 6.

FIG. 4 is an exemplary illustration of a joint protector 400 that employs one pad 110 to protect the user's joint. Joint protector 400 may be utilized to protect various joints of the user, including but not limited to a user's shoulder, knee, elbow, or wrist. The overall shape of pad 110 may be concave. The concave shape may increase the level of protection provided to the user's joint by facilitating the pad's 110 ability to wrap around the user's joint and limb. When pad 110 is designed to wrap around the user's joint, the width 116 of the pad 110 is generally larger than otherwise provided herein. Further, the width 116 of pad 110 may be larger at a midpoint of the pad 110 than at the ends 118 and/or 120 of the pad 110.

In an exemplary embodiment, a joint protector 400 configured to be worn on a user's wrist may have a pad 110 with a length 114 of between about three inches and about nine inches and a width 116 of between about two inches and about eight inches. In one embodiment, pad 110, which is configured for a user's wrist, has a length 114 of about six inches and a width 116 of about five and half inches. Desirably, the length 114 of the pad 110 may be sized to extend from an area above the user's wrist to an area below a position where the user's thumb meets the user's hand. The pad 110 may be configured to wrap around the user's joint and limb by increasing the width 116 of pad 110 by between 0% and 300%.

Pad 110 may be configured such that one end 118 or 120 of pad 110 is on one side of the user's joint while the other end 118 or 120 of pad 110 is on the other side of the user's joint. In one embodiment, the first end 118 of the pad 110 is the end closer to the user's hand.

The first and second ends 118 and 120 have contours 122 and 124, respectively. In one embodiment, the first end 118 has a contour 122 that is concave. In this embodiment, the concave contour 122 of the first end 118 is beneficial for joint protectors configured to protect a user's wrist and/or hand because the concave contour 122 does not inhibit movement of the user's fingers while the concave contour 122 maximizes the protection for the user's hand. Additionally, the first end 118 may be part of the projecting portion 126. Desirably, the projecting portion 126 extends toward the users knuckles to protect the bones, ligaments and tendons, in the user's hand, particularly those between the knuckles and wrist, e.g., the metacarpus and carpus bones. In one embodiment, the projecting portion 126 is less than about two inches long. In another embodiment, the projecting portion 126 is less than about three inches long. Yet in another embodiment, the projecting portion 126 is equal to or greater than about three inches long.

The first pad 110 may have one or more cuts 402 along at least a portion of a width 116 of pad 110. The cuts 402 facilitate movement (e.g., bending, folding, stretching, etc.) along the cuts 402 by reducing the amount of the padding layer 112 that must be deformed to produce such movement. The cuts 402 may be configured to form a shape into the pad, e.g., a triangle, semi-circle, etc., to further facilitate movement of the pad 110 along the cuts 402. Additionally, the one or more cuts 402 may be partially or completely through the pad 110. When the joint protector 100 is configured for a user's wrist, desirably, the one or more cuts 402 is configured to be positioned over the user's wrist to increase the user's ability to easily move their hand. In one embodiment, the one or more cuts 402 may comprise a pair of cuts 402*a* and 402*b* that extend from opposed sides of the pad 110 at a same point along the length 114 of the pad 110. In another embodiment, one or more cuts 402 extend inward at the base 127 of the projecting portion 126 of the pad 110.

FIGS. 5-8 are exemplary illustrations of joint protectors 400 that employ one or more connectors 140 to facilitate affixing pad 110 to a user's joint and/or limb. The connector 140, which is coupled to the pad 110, may be configured to attach the pad 110 to a limb of a user such that one end 118 or 120 of the pad 110 is positioned on one side of the user's wrist and the opposite end 118 or 120 of the pad 110 is positioned on an opposite side of the user's wrist. In one embodiment, connector 140 maintains pad 110 against the user's joint (e.g., wrist) and/or limb (e.g., hand). In another embodiment, a portion of the pad 110 (e.g., the projecting portion 126) is not maintained against the limb of the user by the connector 140 (e.g., elastic material) along the entire length 114 of the pad 110. The connector 140 may extend beyond one or more of the ends 118 and/or 120 of pad 110. In one embodiment, the connector 140 extends along the length 114 of pad 110 beyond one end 118 or 120, but not the other end 118 or 120.

The connector 140 may be configured as straps, a sleeve, and/or similarly to attach pad 110 to the joint and/or limb of the user. In one embodiment, the connector 140 includes releasable affixing features, such as Velcro, zippers, buttons, latches, etc., that are employed to facilitate the user's ability to attach (e.g., put on, take off, and/or wear) the joint protector 400 to the user's joint and/or limb. In an alternative embodiment, the connector 140 is made from an elastic material that enables the user to elastically deform the connector 140 to facilitate the attachment of the joint protector 400 to the user's joint and/or limb. The connector 140 may define a recess configured for the user's joint and/or limb. The connector 140 may also delineate an opening 145 that extends through the connector 140, thereby enabling access to the recess extending through the connector 140. In one embodiment, the opening 145 delineated by the connector 140 is configured for the thumb of a user. In another embodiment, the opening 145 delineated by the connector 140 is near a midpoint of the pad 110 that has a width 116 that is larger than the width 116 of the pad 110 at the ends 118 or 120. Extra material or stitching may be secured to the connector 140 near and/or around the delineated opening 145 to increase durability of the connector 140 and reduce the likelihood of tears, rips, or the like.

Connector 140 may be attached to the respective side edges 117 along the width 116 of the pad 110. In one embodiment, the connector 140 urges the pad 110 to wrap around the user's joint and/or limb by biasing the respective side edges 117 along the width 116 of pad 110 toward each other. In an alternative embodiment, the one or more cuts 402 extend inward at the base 127 of the projecting portion 126 of pad 110 and the connector 140 biases the respective side edges 117 of the width 116 before such cuts 402 so that the respective side edges 117 hinder the projecting portion 126 from bending toward the user's hand and/or wrist. Employing this embodiment enables the projecting portion 126 to bend away from the user's hand and/or wrist with minimal resistance while providing additional impact-resistance by increasing the force required to bend the projecting portion 126 of the pad 110 toward the user's hand and/or wrist.

Although the invention is illustrated and described herein with reference to specific embodiments, the invention is not intended to be limited to the details shown. Rather, various modifications may be made in the details within the scope and range of equivalents of the claims and without departing from the invention. In particular, any of the features described herein with respect to one embodiment may be provided in any of the other embodiments.

What is claimed:

1. A joint protector comprising:

a first pad having a length extending along a first axis;

a second pad separate from the first pad and having a length extending along a second axis, an end of the first pad adjacent the second pad and configured to align with an end of the second pad that is adjacent the first pad; and a connector coupled to the first and second pads, the connector configured to attach the first and second pads to a limb of a user such that the first pad is positioned on one side of the joint of the user and the second pad is positioned on an opposite side of the joint of the user, the connector comprising an elastic material secured to edges of the first pad and edges of the second pad, the elastic material unsecured to (i) the end of the first pad adjacent the second pad and (ii) a portion of the edges of the first pad extending from the end of the first pad adjacent the second pad along the length of the pad, wherein the joint protector is movable to be in a first state in which the first axis aligns with the second axis and the end of the first pad aligns with the end of the second pad, and to be in a second state in which the first axis is angled relative to the second axis and the end of the first pad is not aligned with the end of the second pad.

2. The joint protector of claim 1, wherein the edges of the first and second pads include respective side edges and the first and second pads have respective top surfaces, and when the joint protector is in the first state, the respective side edges and top surfaces of the first and second pads are aligned.

3. The joint protector of claim 1, wherein the elastic material comprises an elastic sleeve having a length longer than a sum of the lengths of the first and second pads.

4. The joint protector of claim 1, wherein the elastic material is secured to the edges of the second pad along the entire length of the second pad.

5. The joint protector of claim 1, wherein the first pad and the second pad are formed from a material that retains its shape when the user bends his or her joint.

6. The joint protector of claim 1, wherein the end of the first pad has a first contour, and the end of the second pad has a second contour shaped to mate with the first contour.

7. The joint protector of claim 1, wherein the first contour includes a projecting portion, and the second contour includes an indent portion having a size and shape corresponding to the projecting portion.

8. The joint protector of claim 1, wherein the first and second pads each comprise at least one layer of elastomeric material and at least one layer of high tensile strength fibrous material.

9. The joint protector of claim 1, wherein the first and second pads are sized to be worn adjacent an elbow of the user.

10. The joint protector of claim 1, wherein the first and second pads are sized to be worn adjacent a knee of the user.

* * * * *